US012497869B2

(12) United States Patent
Dyer et al.

(10) Patent No.: US 12,497,869 B2
(45) Date of Patent: Dec. 16, 2025

(54) PERFORATING GUN STRING INCLUDING SWITCH COUNTER

(71) Applicant: Oso Perforating, LLC, Irving, TX (US)

(72) Inventors: John Dyer, Norman, OK (US); David Milligan, Oklahoma City, OK (US); Jeremy Ursi, Frisco, TX (US); Nathan McFarland, Euless, TX (US); Kerron James, Fort Worth, TX (US); Varun Garg, Dallas, TX (US)

(73) Assignee: Oso Perforating, LLC, Irving, TX (US)

( * ) Notice: Subject to any disclaimer, the term of this patent is extended or adjusted under 35 U.S.C. 154(b) by 0 days.

(21) Appl. No.: 19/052,564

(22) Filed: Feb. 13, 2025

(65) Prior Publication Data

US 2025/0257634 A1 Aug. 14, 2025

Related U.S. Application Data

(60) Provisional application No. 63/552,947, filed on Feb. 13, 2024.

(51) Int. Cl.
*E21B 43/1185* (2006.01)

(52) U.S. Cl.
CPC ..... *E21B 43/1185* (2013.01)

(58) Field of Classification Search
CPC ..... E21B 43/1185; E21B 43/116; E21B 43/11857; F42D 1/05; F42D 1/045; F42B 3/10

See application file for complete search history.

(56) References Cited

U.S. PATENT DOCUMENTS

| | | | | |
|---|---|---|---|---|
| 5,339,741 | A * | 8/1994 | Craven | F42B 4/00 102/493 |
| 11,649,684 | B2 * | 5/2023 | Garg | E21B 17/10 166/241.6 |
| 12,012,829 | B1 * | 6/2024 | Roach | E21B 43/119 |
| 12,049,791 | B2 * | 7/2024 | Garg | E21B 43/117 |
| 12,258,844 | B2 * | 3/2025 | Sullivan | E21B 23/065 |
| 2020/0256168 | A1 * | 8/2020 | Knight | E21B 43/1185 |
| 2022/0034221 | A1 * | 2/2022 | Archibald | E21B 43/1185 |
| 2022/0412195 | A1 * | 12/2022 | Vriend | F42C 21/00 |
| 2023/0366298 | A1 * | 11/2023 | Sullivan | F42D 1/02 |

(Continued)

FOREIGN PATENT DOCUMENTS

CN 204002775 U * 12/2014

*Primary Examiner* — Daniel P Stephenson
(74) *Attorney, Agent, or Firm* — HAYNES AND BOONE, LLP

(57) ABSTRACT

A perforating gun string includes a release tool, a perforating gun, and a plug. The perforating gun string may include or be part of a downhole tool that is electrically communicable via a control system. A first switch (or "RT switch") is associated with the release tool and is operably coupled to a first detonator. A second switch (or "gun switch") is associated with the perforating gun and is operably coupled to a second detonator. A third switch (or "plug switch") is associated with the plug and is operably coupled to an igniter. A counter system includes a plurality of counters adapted to track usage of one or more switches in the perforating gun string, including the first switch, the second switch, the third switch, or any combination thereof.

30 Claims, 7 Drawing Sheets

(56) References Cited

U.S. PATENT DOCUMENTS

| | | | | |
|---|---|---|---|---|
| 2024/0352834 | A1* | 10/2024 | Sullivan | E21B 43/119 |
| 2024/0384607 | A1* | 11/2024 | Garg | E21B 43/116 |
| 2025/0012174 | A1* | 1/2025 | Shearer | E21B 43/1185 |
| 2025/0092764 | A1* | 3/2025 | Ursi | E21B 43/119 |

* cited by examiner

PERFORATING GUN STRING INCLUDING SWITCH COUNTER

CROSS-REFERENCE TO RELATED APPLICATIONS

This application claims the benefit of the filing date of, and priority to, U.S. Patent Application No. 63/552,947 (the "'947 Application"), filed Feb. 13, 2024, the entire disclosure of which is hereby incorporated herein by reference.

The '947 Application is related to U.S. patent application Ser. No. 17/365,178, filed Jul. 1, 2021, now issued as U.S. Pat. No. 11,414,951 (the "'951 Patent"), which claims the benefit of the filing date of, and priority to, U.S. Patent Application No. 63/047,062, filed Jul. 1, 2020, the entire disclosures of which are hereby incorporated herein by reference.

The '947 Application is also related to U.S. patent application Ser. No. 18/317,188, filed May 15, 2023, which is a continuation of U.S. patent application Ser. No. 17/869,320, filed Jul. 20, 2022, now issued as U.S. Pat. No. 11,649,684 (the "'684 Patent"), which claims the benefit of the filing date of, and priority to, U.S. Patent Application No. 63/355,440, filed Jun. 24, 2022, and U.S. Patent Application No. 63/224,338, filed Jul. 21, 2021, the entire disclosures of which are hereby incorporated herein by reference.

The '947 Application is also related to U.S. Patent Application No. 63/497,900 (the "'900 Application"), filed Apr. 24, 2023, the entire disclosure of which is hereby incorporated herein by reference.

The '947 Application is also related to U.S. Patent Application No. 63/582,880 (the "'880 Application"), filed Sep. 15, 2023, the entire disclosure of which is hereby incorporated herein by reference.

TECHNICAL FIELD

The present disclosure relates generally to perforating guns used in oil and gas completions operations, and, more particularly, a perforating gun string including one or more switch usage counters.

DETAILED DESCRIPTION

Figure 1:
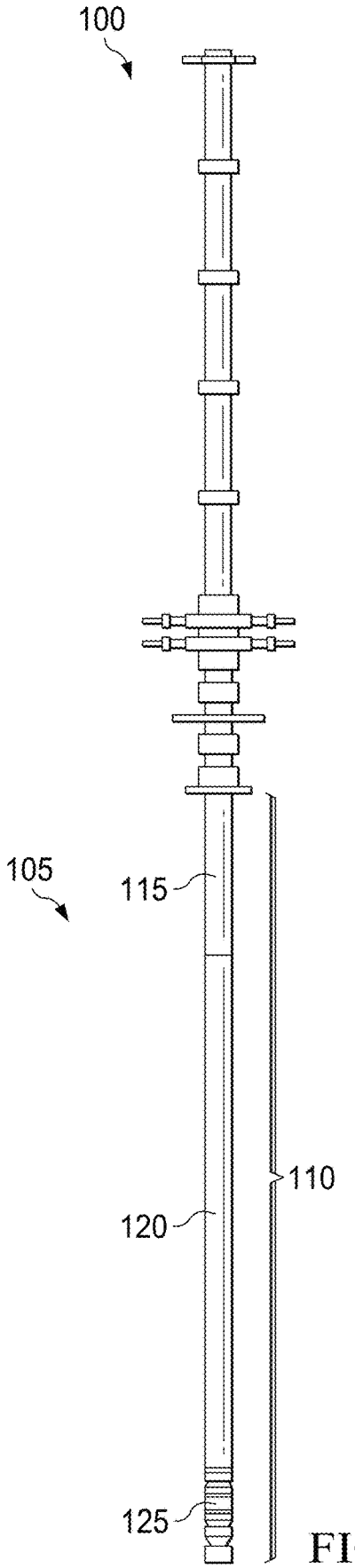
FIG. 1 illustrates a system, the system including a downhole tool, the downhole tool including a release tool, perforating gun(s), and a plug (also collectively referred to as a "gun string"), according to one or more embodiments of the present disclosure.

Referring to FIG. 1, a system 100 including a downhole tool 105 is illustrated according to one or more embodiments of the present disclosure. The downhole tool 105 is or includes a perforating gun string 110. The perforating gun string 110 includes a release tool 115, perforating gun(s) 120, and a plug 125. The purpose of the release tool 115 is to release the rest of the perforating gun string 110 (including the perforating gun(s) 120 and the plug 125) downhole in the event of an anomaly failure. In one or more embodiments, the perforating gun string 110 includes one (1) release tool 115, one to thirty (1-30) perforating guns 120, and one (1) plug 125. A "stage" refers to one (1) run of the perforating gun string 110.

Figure 2:
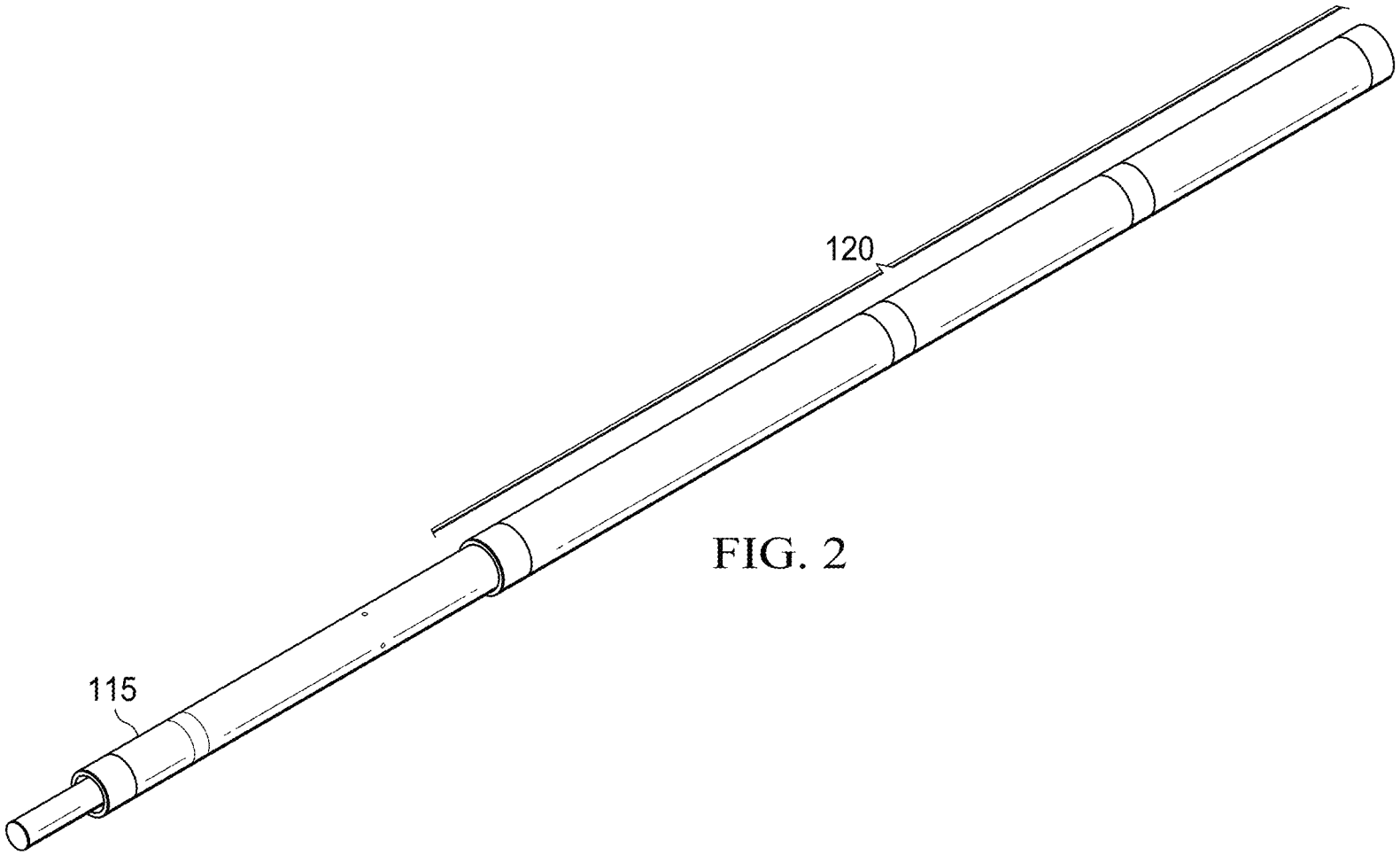
FIG. 2 illustrates the release tool and the perforating gun(s) of FIG. 1 in a partially-assembled state or configuration, according to one or more embodiments of the present disclosure.

Referring to FIG. 2, with continuing reference to FIG. 1, the release tool 115 and the perforating gun(s) 120 are illustrated in a partially-assembled state or configuration according to one or more embodiments of the present disclosure.

Figure 3:
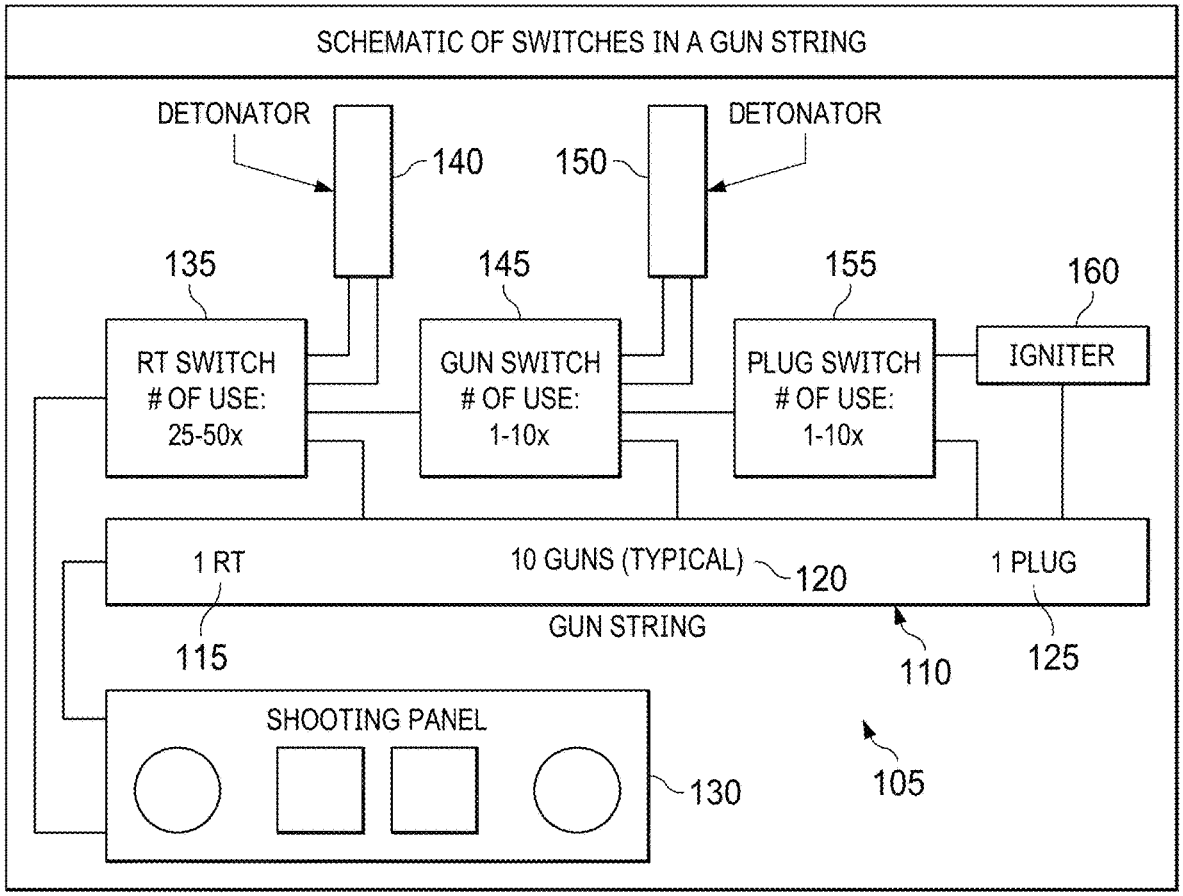
FIG. 3 is a diagram of a shooting panel and the downhole tool of FIG. 1, which is electrically communicable via the shooting panel and includes the release tool, the perforating gun(s), the plug, an "RT switch" associated with the release tool, a detonator to which the RT switch is operably coupled, a "gun switch" associated with a particular perforating gun, another detonator to which the gun switch is operably coupled, a "plug switch" associated with the plug, and an igniter to which the plug switch is operably coupled, according to one or more embodiments of the present disclosure.

Referring to FIG. 3, with continuing reference to FIG. 1, the downhole tool 105 is illustrated according to one or more embodiments of the present disclosure. The downhole tool 105 is electrically communicable via a shooting panel 130 and includes the release tool 115, the perforating gun(s) 120, the plug 125, a switch (or "RT switch") 135 associated with the release tool 115, a detonator 140 to which the switch 135 is operably coupled, a switch (or "gun switch") 145 (or switches) associated with the perforating gun(s) 120, a detonator 150 (or detonators) to which the switch 145 (or switches) is operably coupled, a switch (or "plug switch") 155 associated with the plug 125, and an igniter 160 to which the switch 155 is operably coupled. In one or more embodiments, the switch 135, the switch 145 (or switches), and the switch 155 are addressable switches. An addressable switch in a perforating gun string (e.g., the perforating gun string 110) has a maximum recommended life, and overusing it could result in failures and misruns.

Figure 4:
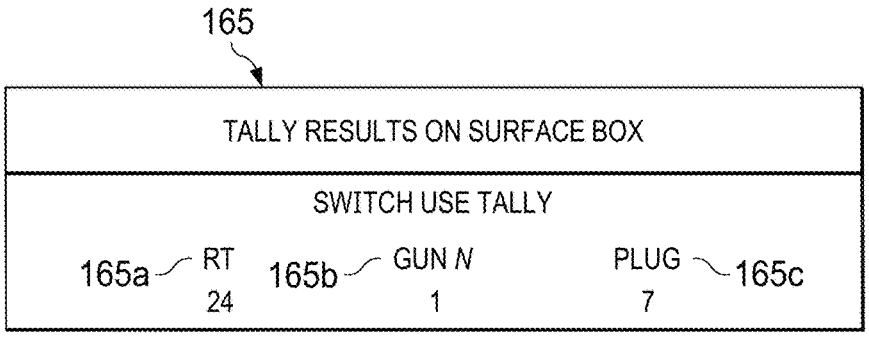
FIG. 4 illustrates a counter system including an "RT counter," a "gun N counter," and a "plug counter," via which usage is adapted to be tracked for the RT switch, the gun switch, and the plug switch, respectively, of FIG. 3, according to one or more embodiments of the present disclosure.

Referring to FIG. 4, with continuing reference to FIG. 3, a counter system 165 includes a counter (or "RT counter") 165*a*, a counter (or "gun N counter") 165*b*, and a counter (or "plug counter") 165*c*, via which usage is adapted to be tracked for the switch 135, the switch 145 (or switches), and the switch 155, respectively, according to one or more embodiments of the present disclosure. Specifically, the respective counters 165*a-c* of the in-built counter system 165 keep track of the number of runs of the addressable switches 135, 145, 155, eliminating the need to manually track switch usage on location (e.g., by using paint pen marking on system hardware or manually counting the number of runs) and decreasing the likelihood of overusing the switches 135, 145, 155 above their recommended limits. In one or more embodiments, each of the counters 165*a-c* of the counter system 165 is built into one or any combination of the switches 135, 145, 155 using firmware coding. Each time a switch (e.g., the switch 135, 145, 155) undergoes a fire command, the corresponding counter (or counters) of the counter system 165 increments by one (1) and is stored in the switch (or switches). When an operator on location is firing the switch (or switches) using a software interface (e.g., the software interface 185 described below in connection with FIG. 7), the run tally is displayed in the software. Additionally, or alternatively, the run tally may be shown onscreen during the surface box inventory check (e.g., using the surface tester 170 described below in connection with FIG. 6). Among other things, the counter system 165 keeps track of the number of runs on each switch, and alerts crew when it is time to use a new switch (possibly averting a misrun due to an overused switch). Overusing a switch (e.g., the switch 135, 145, 155) degrades the electronic components in the switch due to repeated exposure to high voltage, current, metal-oxide-semiconductor field-effect transistors (or "MOSFETs") switching on and off, electro-static discharge, etc.

Figure 5:
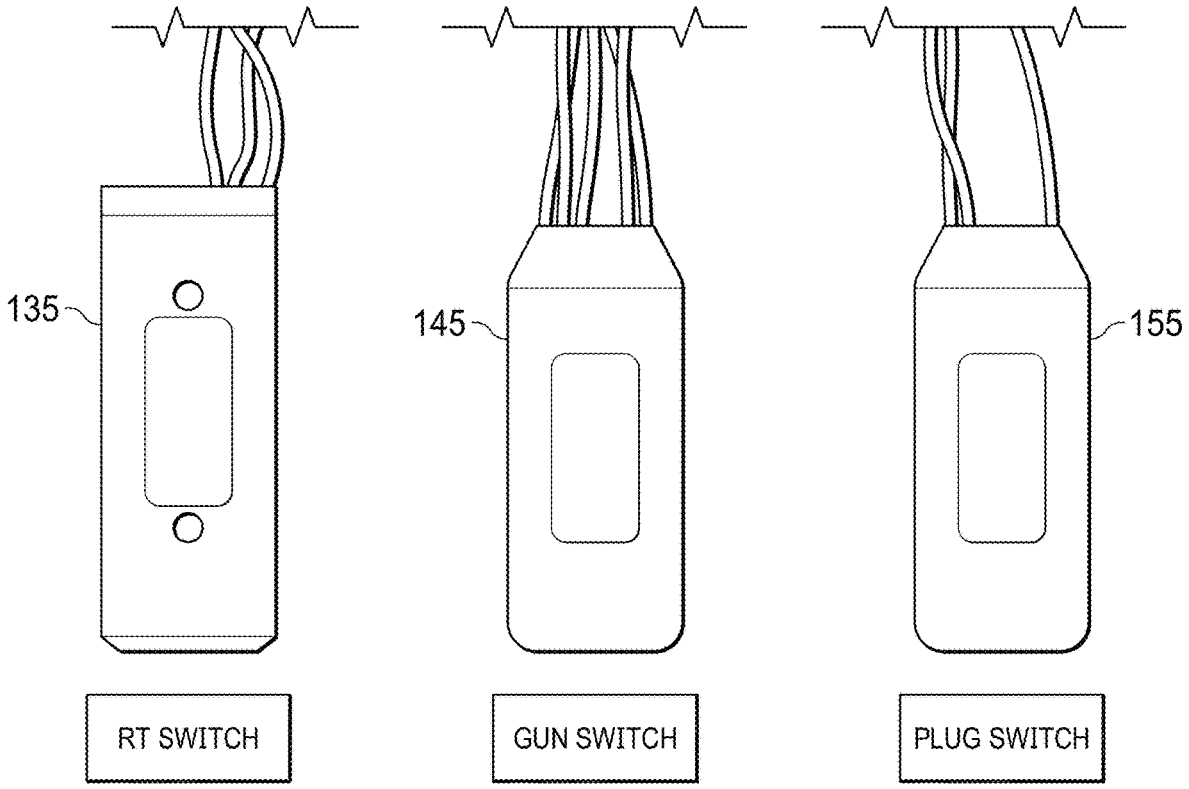
FIG. 5 illustrates the RT switch, the gun switch, and the plug switch of FIG. 3, according to one or more embodiments of the present disclosure.

Referring to FIG. 5, with continuing reference to FIG. 3, the switch (or "RT switch") 135, the switch (or "gun switch") 145, and the switch (or "plug switch") 155 are illustrated according to one or more embodiments of the present disclosure. In one or more embodiments, the hardware design of each switch is the same, except that different addresses are assigned to classify the type of switch. Specifically, each switch may have a combination of four (4) hexadecimal digits/letters, providing 65,536 unique combinations of possible addresses. For example, the address of the switch (or "RT switch") 135 may be constant for all such switches (e.g., BBBB). Likewise, the address of the switch (or "plug switch") 155 may be constant for all such switches (e.g., FFFF). This results in 65,534 unique combinations of possible addresses for the switch (or "gun switch") 145 (or switches). This unique address example enables the shooting panel 130 and the surface box (e.g., the surface tester 170 described below in connection with FIG. 6) to determine the type of switch being addressed (or not) in the perforating gun string 110. The RT switch 135 is installed in the release tool 115 and is used for twenty-five to fifty (25-50) stages before replacing (assuming it is never fired). The gun switch 145 (or switches) are conventionally used one (1) time in each perforating gun 120 before being destroyed by the blast. However, the counter system 165 facilitates protecting and re-using the gun switch 145 (or switches) up to ten (10) times or more. Firing a gun switch (e.g., the gun switch 145) will increase the corresponding counter 165*b* (i.e., the "gun N counter") of the counter system 165 by 1. The plug switch 155 is protected inside an encapsulation and is used ten (10) times or more before replacing. Firing a plug switch (e.g., the plug switch 155) will increase the corresponding counter 165*c* (i.e., the "plug counter") of the counter system 165 by one (1).

Figure 6:
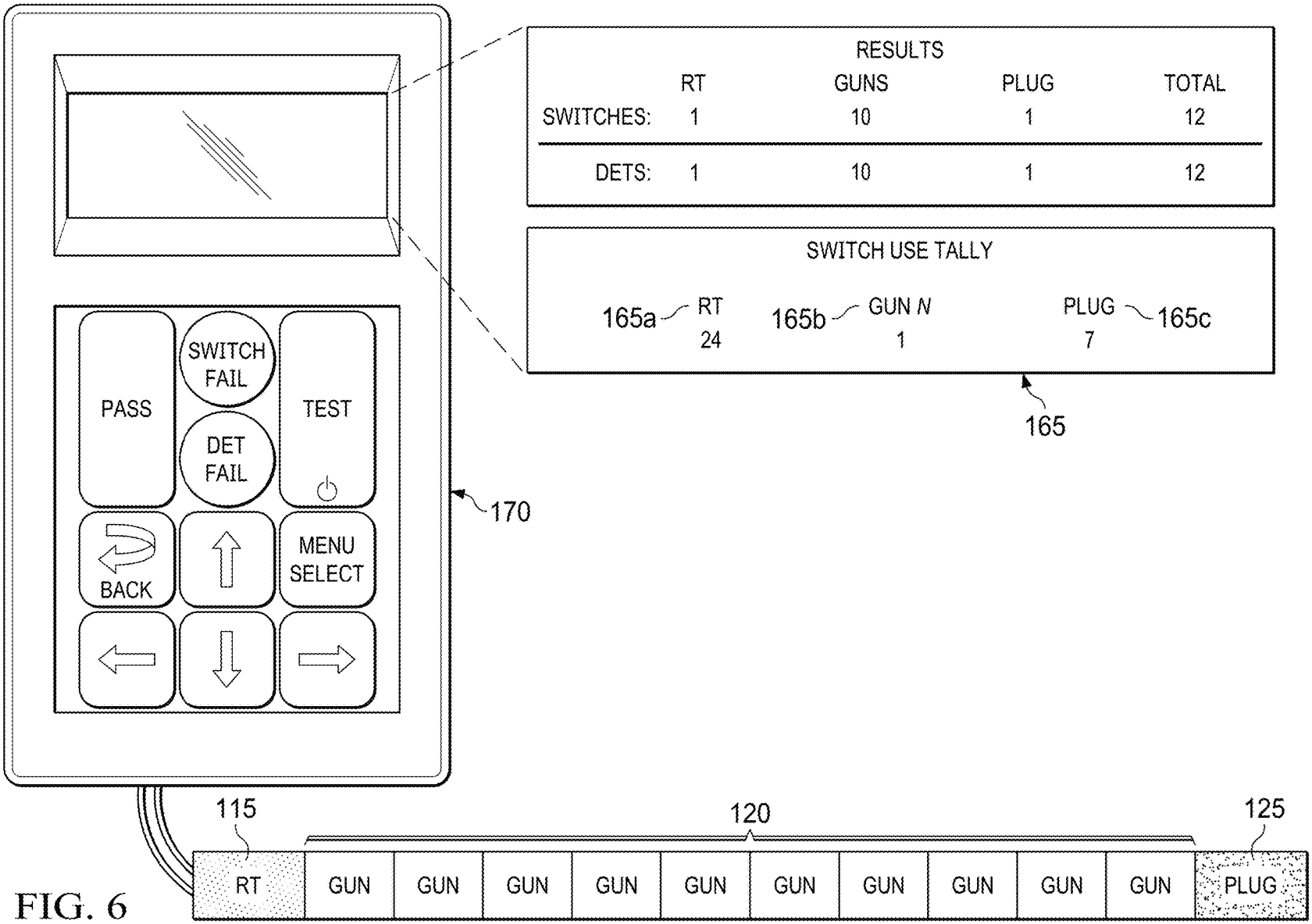
FIG. 6 illustrates a surface tester adapted to be in electrical communication with the gun string of FIG. 1, according to one or more embodiments of the present disclosure.

Referring to FIG. 6, with continuing reference to FIGS. 1 and 3, a surface tester 170 adapted to be in electrical communication with the perforating gun string 110 is illustrated according to one or more embodiments of the present disclosure. A process for surface-checking the perforating gun string 110 includes assembling the perforating gun string 110 at a surface location and connecting the surface tester 170 to the perforating gun string 110 to ensure proper electrical communication through the perforating gun string 110 (including reading and validating all addressable switches 135, 145, 155). After the surface test is successful, the perforating gun string 110 can be sent downhole via wireline.

Figure 7:
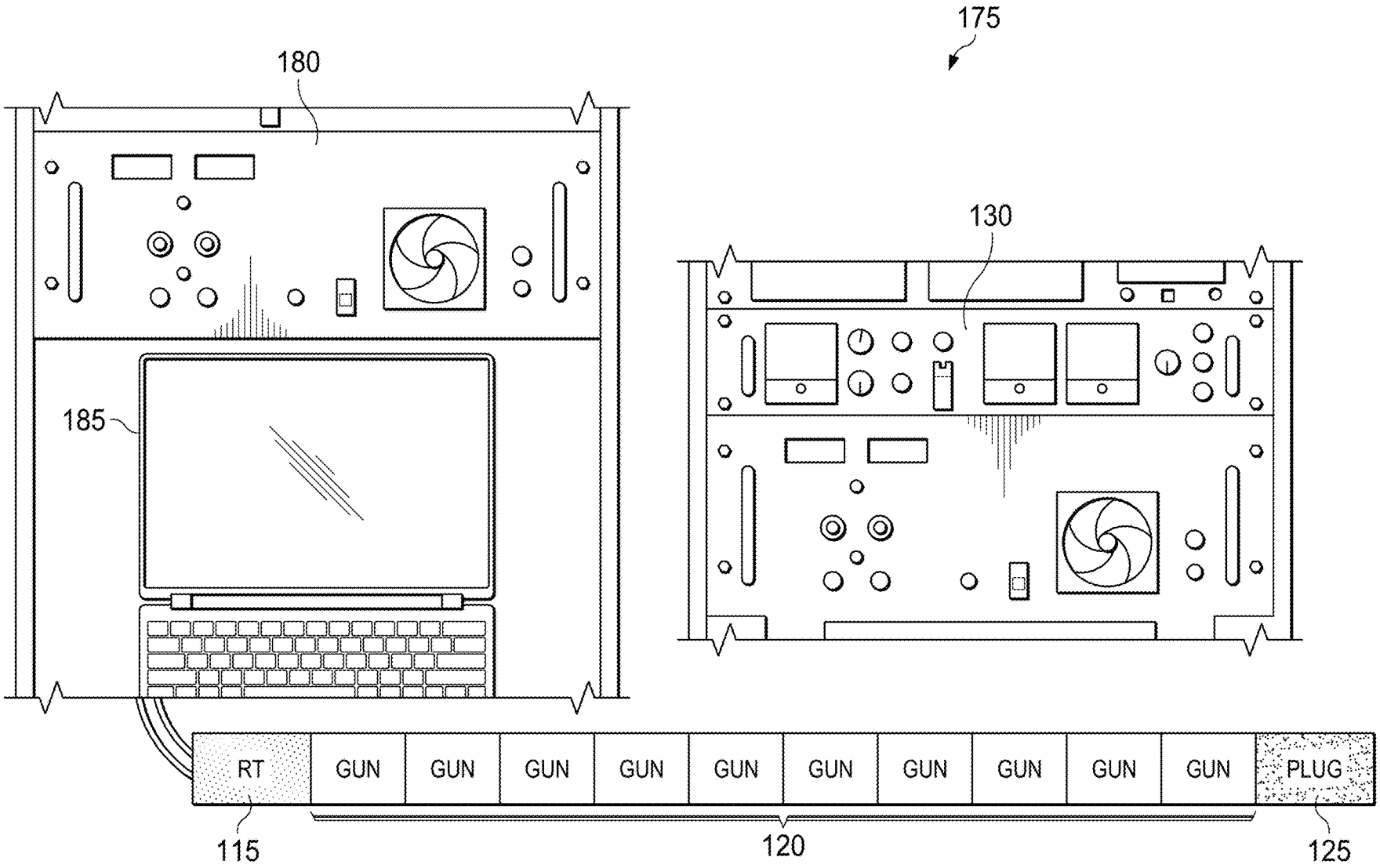
FIG. 7 illustrates a control system adapted to be in electrical communication with the gun string of FIG. 1, which control system includes the shooting panel of FIG. 3, a logging panel, and a software interface, according to one or more embodiments.

Referring to FIG. 7, with continuing reference to FIGS. 1 and 3, a control system 175 adapted to be in electrical communication with the perforating gun string 110 is illustrated according to one or more embodiments of the present disclosure. The control system 175 includes the shooting panel 130, a logging panel 180, and a software interface 185. A process for shooting the perforating gun string 110 downhole includes pumping the perforating gun string 110 downhole to depth for "plug and perf" operations. Using the software interface 185, the perforating gun string 110 is inventoried during the trip to depth to validate that all of the switches 135, 145, 155 are detected. At depth, the switches 135, 145, 155 are inventoried again, followed by firing the plug switch 155 first. At this point, the (RT) counter 165*a* of the counter system 165 will increment by one (1) for the RT switch 135, and the (plug) counter 165*c* of the counter system 165 will increment by one (1) for the plug switch 155. After the plug 125 has been shot, the perforating gun(s) 120 are shot. At this point, the (gun N) counter 165*b* of the counter system 165 will increment by one (1) for the gun switch 145 (or switches).

Figure 8:
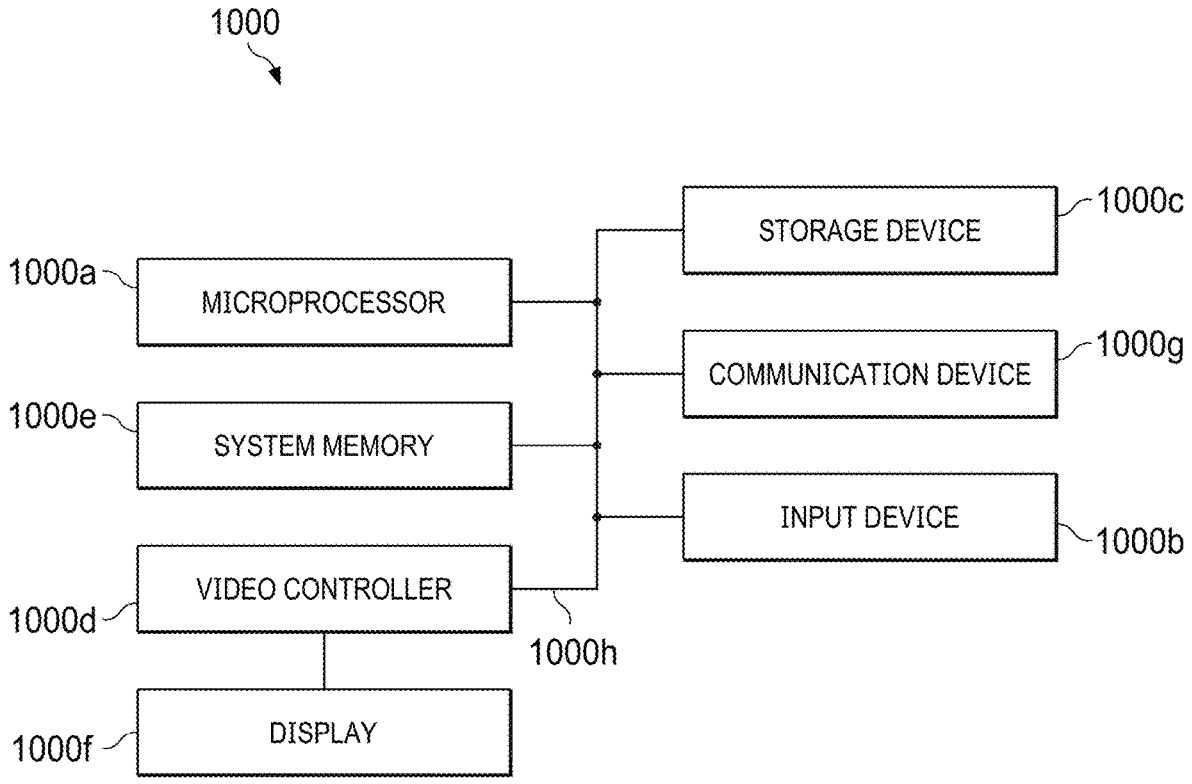
FIG. 8 illustrates a computing node for implementing one or more embodiments of the present disclosure.

Referring to FIG. 8, with continuing reference to FIGS. 1-7, in one or more embodiments, a computing node 1000 for implementing one or more of the above-described embodiments, and/or any combination thereof, is depicted. In one or more embodiments, the node 1000 is, includes, or is part of the RT switch 135 shown and described above. In one or more embodiments, the node 1000 is, includes, or is part of the gun switch 145 (or switches) shown and described above. In one or more embodiments, the node 1000 is, includes, or is part of the plug switch 155 shown and described above. In one or more embodiments, the node 1000 is, includes, or is part of the counter system 165 shown and described above. In one or more embodiments, the node 1000 is, includes, or is part of the surface tester 170 shown and described above. In one or more embodiments, the node 1000 is, includes, or is part of the control system 175 shown and described above. In one or more embodiments, the node 1000 is, includes, or is part of the shooting panel 130 shown and described above. In one or more embodiments, the node 1000 is, includes, or is part of the logging panel 180 shown and described above. In one or more embodiments, the node 1000 is, includes, or is part of the software interface 185 shown and described above.

The node 1000 includes a microprocessor 1000*a*, an input device 1000*b*, a storage device 1000*c*, a video controller 1000*d*, a system memory 1000*e*, a display 1000*f*, and a communication device 1000*g* all interconnected by one or more buses 1000*h*. In one or more embodiments, the microprocessor 1000*a* is, includes, or is part of, the phantom and/or the instruments described herein. In one or more embodiments, the storage device 1000*c* may include a floppy drive, hard drive, CD-ROM, optical drive, any other form of storage device or any combination thereof. In one or more embodiments, the storage device 1000*c* may include, and/or be capable of receiving, a floppy disk, CD-ROM, DVD-ROM, or any other form of computer-readable medium that may contain executable instructions. In one or more embodiments, the communication device 1000*g* may include a modem, network card, or any other device to enable the node 1000 to communicate with other nodes. In one or more embodiments, any node represents a plurality of interconnected (whether by intranet or Internet) computer systems, including without limitation, personal computers, mainframes, PDAs, smartphones and cell phones.

In one or more embodiments, one or more of the components of any of the above-described embodiments include at least the node 1000 and/or components thereof, and/or one or more nodes that are substantially similar to the node 1000 and/or components thereof. In one or more embodiments, one or more of the above-described components of the node 1000 and/or the above-described embodiments include respective pluralities of same components.

In one or more embodiments, a computer system includes at least hardware capable of executing machine readable instructions, as well as the software for executing acts (typically machine-readable instructions) that produce a desired result. In one or more embodiments, a computer system includes hybrids of hardware and software, as well as computer sub-systems.

In one or more embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In one or more embodiments, hardware may include any physical device that is capable of storing machine-readable instructions, such as memory or other data storage devices. In one or more embodiments, other forms of hardware include hardware sub-systems, including transfer devices such as modems, modem cards, ports, and port cards, for example.

In one or more embodiments, software includes any machine code stored in any memory medium, such as RAM or ROM, and machine code stored on other devices (such as floppy disks, flash memory, or a CD ROM, for example). In one or more embodiments, software may include source or object code. In one or more embodiments, software encompasses any set of instructions capable of being executed on a node such as, for example, on a client machine or server.

In one or more embodiments, combinations of software and hardware could also be used for providing enhanced functionality and performance for certain embodiments of the present disclosure. In one or more embodiments, software functions may be directly manufactured into a silicon chip. Accordingly, combinations of hardware and software are also included within the definition of a computer system and are thus envisioned by the present disclosure as possible equivalent structures and equivalent methods.

In one or more embodiments, computer readable mediums include, for example, passive data storage, such as a random-access memory (RAM) as well as semi-permanent data storage such as a compact disk read only memory (CD-ROM). One or more embodiments of the present disclosure may be embodied in the RAM of a computer to transform a standard computer into a new specific computing machine. In one or more embodiments, data structures are defined organizations of data that may enable one or more embodiments of the present disclosure. In one or more embodiments, data structure may provide an organization of data, or an organization of executable code.

In one or more embodiments, any networks and/or one or more portions thereof, may be designed to work on any specific architecture. In one or more embodiments, one or more portions of any networks may be executed on a single computer, local area networks, client-server networks, wide area networks, internets, hand-held and other portable and wireless devices and networks.

In one or more embodiments, database may be any standard or proprietary database software. In one or more embodiments, the database may have fields, records, data, and other database elements that may be associated through database specific software. In one or more embodiments, data may be mapped. In one or more embodiments, mapping is the process of associating one data entry with another data entry. In one or more embodiments, the data contained in the location of a character file can be mapped to a field in a second table. In one or more embodiments, the physical location of the database is not limiting, and the database may be distributed. In one or more embodiments, the database may exist remotely from the server, and run on a separate platform. In one or more embodiments, the database may be accessible across the Internet. In one or more embodiments, more than one database may be implemented.

In one or more embodiments, a plurality of instructions stored on a non-transitory computer readable medium may be executed by one or more processors to cause the one or more processors to carry out or implement in whole or in part the above-described operation of each of the above-described embodiments, and/or any combination thereof. In one or more embodiments, such a processor may be or include one or more of the microprocessor 1000*a*, one or more other controllers, any processor(s) that are part of the components of the above-described embodiments, and/or any combination thereof, and such a non-transitory computer readable medium may be part of the node 1000 or component(s) thereof, and/or may be distributed among one or more components of the above-described systems. In one or more embodiments, such a processor may execute the plurality of instructions in connection with a virtual computer system. In one or more embodiments, such a plurality of instructions may communicate directly with the one or more processors, and/or may interact with one or more operating systems, middleware, firmware, other applications, and/or any combination thereof, to cause the one or more processors to execute the instructions.

One or more embodiments of the present application are provided in whole or in part as described in the '947 Application, which forms part of the present application. It is understood that one or more of the embodiments described above and shown FIGS. 1-8 may be combined in whole or in part with one or more of the embodiments described and illustrated in the '947 Application, and/or one or more other embodiments described above and shown in FIGS. 1-8.

In several embodiments, one or more of the embodiments described above and shown in FIGS. 1-8 and/or one or more of the embodiments described and illustrated in the '947 Application may be combined in whole or in part with one or more of the embodiments described and illustrated in the '951 Patent, the entire disclosure of which: has been incorporated herein by reference; and is included in the '947 Application, which forms part of the present application.

Additionally, or alternatively, one or more of the embodiments described above and shown in FIGS. 1-8 and/or one or more of the embodiments described and illustrated in the '947 Application may be combined in whole or in part with one or more of the embodiments described and illustrated in the '684 Patent, the entire disclosure of which: has been incorporated herein by reference; and is included in the '947 Application, which forms part of the present application.

Additionally, or alternatively, one or more of the embodiments described above and shown in FIGS. 1-8 and/or one or more of the embodiments described and illustrated in the '947 Application may be combined in whole or in part with one or more of the embodiments described and illustrated in the '900 Application, the entire disclosure of which: has been incorporated herein by reference; and is included in the '947 Application, which forms part of the present application.

Additionally, or alternatively, one or more of the embodiments described above and shown in FIGS. 1-8 and/or one or more of the embodiments described and illustrated in the '947 Application may be combined in whole or in part with one or more of the embodiments described and illustrated in the '880 Application, the entire disclosure of which: has been incorporated herein by reference; and is included in the '947 Application, which forms part of the present application.

In several embodiments, one or more of the embodiments described and illustrated in the '947 Application are combined in whole or in part with one or more of the embodiments described above and shown in FIGS. 1-8 and/or one or more of the other embodiments described and illustrated in the '947 Application.

A perforating gun string has been introduced according to one or more embodiments of the present disclosure. The perforating gun string generally includes: a perforating gun; a plug; a plurality of addressable switches, including: a first addressable switch associated with the plug and fireable to set the plug downhole in a wellbore; and a second addressable switch associated with the perforating gun and fireable to detonate the perforating gun downhole in the wellbore; a first counter, wherein, in response to firing the first addressable switch, the first counter is adapted to be incremented for the first addressable switch associated with the plug; and a second counter, wherein, in response to firing the second addressable switch, the second counter is adapted to be incremented for the second addressable switch associated with the perforating gun. In one or more embodiments, the perforating gun string further includes: a counter system including the first and second counters; wherein, after incrementing the first counter for the first addressable switch, the counter system is adapted to communicate a run tally for the first counter via a display; and wherein, after incrementing the second counter for the second addressable switch, the counter system is adapted to communicate a run tally for the second counter via the display. In one or more embodiments, the perforating gun string further includes: an igniter operably coupled to the first addressable switch, wherein firing the first addressable switch initiates the igniter to set the plug downhole in the wellbore. In one or more embodiments, the perforating gun string further includes: a detonator operably coupled to the second addressable switch, wherein firing the second addressable switch initiates the detonator to detonate the perforating gun downhole in the wellbore. In one or more embodiments, the perforating gun string further includes: a release tool; wherein the plurality of addressable switches further includes: a third addressable switch associated with the release tool and fireable to release the perforating gun and the plug into the wellbore from the release tool. In one or more embodiments, the perforating gun string further includes: a third counter; wherein, further in response to firing the first addressable switch associated with the plug, the third counter is adapted to be incremented for the third addressable switch associated with the release tool; and a counter system including the first, second, and third counters; wherein, after incrementing the first counter for the first addressable switch, the counter system is adapted to communicate a run tally for the first counter via a display; and wherein, after incrementing the second counter for the second addressable switch, the counter system is adapted to communicate a run tally for the second counter via the display; and wherein, after incrementing the third counter for the third addressable switch, the counter system is adapted to communicate a run tally for the third counter via the display. In one or more embodiments, the perforating gun string further includes: a detonator operably coupled to the third addressable switch, wherein firing the third addressable switch initiates the detonator to release the perforating gun and the plug in to the wellbore from the release tool. In one or more embodiments, each of the first and second counters is built into one or any combination of the plurality of addressable switches.

A method of tracking usage of one or more addressable switches in a perforating gun string has also been introduced according to one or more embodiments of the present disclosure. The method generally includes: firing a first addressable switch associated with a plug of the perforating gun string to set the plug downhole in a wellbore; in response to firing the first addressable switch, incrementing a first counter of the perforating gun string for the first addressable switch associated with the plug of the perforating gun string; firing a second addressable switch associated with a perforating gun of the perforating gun string to detonate the perforating gun downhole in the wellbore; and in response to firing the second addressable switch, incrementing a second counter of the perforating gun string for the second addressable switch associated with the perforating gun of the perforating gun string. In one or more embodiments, the method further includes: after incrementing the first counter for the first addressable switch, communicating a run tally for the first counter via a display; and after incrementing the second counter for the second addressable switch, communicating a run tally for the second counter via the display. In one or more embodiments, the first addressable switch is operably coupled to an igniter; and firing the first addressable switch initiates the igniter to set the plug downhole in the wellbore. In one or more embodiments, the second addressable switch is associated with a detonator; and firing the second addressable switch initiates the detonator to detonate the perforating gun downhole in the wellbore. In one or more embodiments, the method further includes: further in response to firing the first addressable switch associated with the plug, incrementing a third counter of the perforating gun string for a third addressable switch associated with a release tool of the perforating gun string, wherein the third addressable switch is fireable to release the perforating gun and the plug downhole into the wellbore from the release tool. In one or more embodiments, the third addressable switch is operably coupled to a detonator; and the third addressable switch is fireable to initiate the detonator to release the perforating gun and the plug downhole into the wellbore from the release tool. In one or more embodiments, the method further includes: after incrementing the third counter for the third addressable switch, communicating a run tally for the third counter via the display.

An apparatus adapted to track usage of one or more addressable switches in a perforating gun string has also been introduced according to one or more embodiments of the present disclosure. The apparatus generally includes: a non-transitory computer readable medium; and a plurality of instructions stored on the non-transitory computer readable medium and executable by one or more processors to implement the following steps: firing a first addressable switch associated with a plug of the perforating gun string to set the plug downhole in a wellbore; in response to firing the first addressable switch, incrementing a first counter of the perforating gun string for the first addressable switch associated with the plug of the perforating gun string; firing a second addressable switch associated with a perforating gun of the perforating gun string to detonate the perforating gun downhole in the wellbore; and in response to firing the second addressable switch, incrementing a second counter of the perforating gun string for the second addressable switch associated with the perforating gun of the perforating gun string. In one or more embodiments, the plurality of instructions stored on the non-transitory computer readable medium are executable by the one or more processors to implement the following additional steps: after incrementing the first counter for the first addressable switch, communicating a run tally for the first counter via a display; and after incrementing the second counter for the second addressable switch, communicating a run tally for the second counter via the display. In one or more embodiments, the first addressable switch is operably coupled to an igniter; and firing the first addressable switch initiates the igniter to set the plug downhole in the wellbore. In one or more embodiments, the second addressable switch is associated with a detonator; and firing the second addressable switch initiates the detonator to detonate the perforating gun downhole in the wellbore. In one or more embodiments, the plurality of instructions stored on the non-transitory computer readable medium are executable by the one or more processors to implement the following additional steps: further in response to firing the first addressable switch associated with the plug, incrementing a third counter of the perforating gun string for a third addressable switch associated with a release tool of the perforating gun string, wherein the third addressable switch is fireable to release the perforating gun and the plug downhole into the wellbore from the release tool. In one or more embodiments, the third addressable switch is operably coupled to a detonator; and the third addressable switch is fireable to initiate the detonator to release the perforating gun and the plug downhole into the wellbore from the release tool. In one or more embodiments, the plurality of instructions stored on the non-transitory computer readable medium are executable by the one or more processors to implement the following additional step: after incrementing the third counter for the third addressable switch, communicating a run tally for the third counter via the display.

A counter system adapted to track usage of a plurality of addressable switches in a perforating gun string has also been introduced according to one or more embodiments of the present disclosure. The perforating gun string generally includes: a perforating gun; a plug; and the plurality of addressable switches, including: a first addressable switch associated with the plug and fireable to set the plug downhole in a wellbore; and a second addressable switch associated with the perforating gun and fireable to detonate the perforating gun downhole in the wellbore. The counter system includes first and second counters; wherein, in response to firing the first addressable switch, the first counter is adapted to be incremented for the first addressable switch associated with the plug; and wherein, in response to firing the second addressable switch, the second counter is adapted to be incremented for the second addressable switch associated with the perforating gun. In one or more embodiments, after incrementing the first counter for the first addressable switch, the counter system is adapted to communicate a run tally for the first counter via a display; and, after incrementing the second counter for the second addressable switch, the counter system is adapted to communicate a run tally for the second counter via a display. In one or more embodiments, the perforating gun string further includes: an igniter operably coupled to the first addressable switch, wherein firing the first addressable switch initiates the igniter to set the plug downhole in the wellbore. In one or more embodiments, the perforating gun string further includes: a detonator operably coupled to the second addressable switch, wherein firing the second addressable switch initiates the detonator to detonate the perforating gun downhole in the wellbore. In one or more embodiments, the perforating gun string further includes: a release tool; wherein the plurality of addressable switches further includes: a third addressable switch associated with the release tool and fireable to release the perforating gun and the plug into the wellbore from the release tool. In one or more embodiments, the counter system further includes: a third counter; wherein, further in response to firing the first addressable switch associated with the plug, the third counter is adapted to be incremented for the third addressable switch associated with the release tool; and wherein, after incrementing the first counter for the first addressable switch, the counter system is adapted to communicate a run tally for the first counter via a display; wherein, after incrementing the second counter for the second addressable switch, the counter system is adapted to communicate a run tally for the second counter via a display; and wherein, after incrementing the third counter for the third addressable switch, the counter system is adapted to communicate a run tally for the third counter via the display. In one or more embodiments, the perforating gun string further includes: a detonator operably coupled to the third addressable switch, wherein firing the third addressable switch initiates the detonator to release the perforating gun and the plug in to the wellbore from the release tool. In one or more embodiments, each of the first, second, and third counters is built into one or any combination of the plurality of addressable switches.

A perforating gun system has also been disclosed according to one or more embodiments of the present disclosure.

A downhole tool has also been disclosed according to one or more embodiments of the present disclosure.

A perforating gun string has also been disclosed according to one or more embodiments of the present disclosure.

A release tool has also been disclosed according to one or more embodiments of the present disclosure.

A perforating gun has also been disclosed according to one or more embodiments of the present disclosure.

A plug has also been disclosed according to one or more embodiments of the present disclosure.

A switch has also been disclosed according to one or more embodiments of the present disclosure.

A counter has also been disclosed according to one or more embodiments of the present disclosure.

A counter system has also been disclosed according to one or more embodiments of the present disclosure.

A surface tester has also been disclosed according to one or more embodiments of the present disclosure.

A control system has also been disclosed according to one or more embodiments of the present disclosure.

A shooting panel has also been disclosed, according to one or more embodiments of the present disclosure.

A logging panel has also been disclosed according to one or more embodiments of the present disclosure.

A software interface for a perforating gun system has also been disclosed according to one or more embodiments of the present disclosure.

A method has also been disclosed according to one or more embodiments of the present disclosure.

An apparatus has also been disclosed according to one or more embodiments of the present disclosure.

It is further understood that variations may be made in the foregoing without departing from the scope of the disclosure.

In one or more embodiments, the elements and teachings of the various embodiments disclosed herein may be combined in whole or in part in some or all of said embodiment(s). In addition, one or more of the elements and teachings of the various embodiments disclosed herein may be omitted, at least in part, or combined, at least in part, with one or more of the other elements and teachings of said embodiment(s).

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In one or more embodiments, while different steps, processes, and procedures are described as appearing as distinct acts, one or more of the steps, one or more of the processes, or one or more of the procedures may also be performed in different orders, simultaneously or sequentially. In one or more embodiments, the steps, processes, or procedures may be merged into one or more steps, processes, or procedures. In one or more embodiments, one or more of the operational steps in each embodiment may be omitted. Moreover, in some instances, some features of the present disclosure may be employed without a corresponding use of the other features. Moreover, one or more of the embodiments disclosed above and in the '947 Application, or variations thereof, may be combined in whole or in part with any one or more of the other embodiments described above and in the '947 Application, or variations thereof.

Although various embodiments have been disclosed in detail above and in the '947 Application, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A perforating gun string, comprising:

a perforating gun;

a plug;

a plurality of addressable switches, comprising:

a first addressable switch associated with the plug and fireable to set the plug downhole in a wellbore; and a second addressable switch associated with the perforating gun and fireable to detonate the perforating gun downhole in the wellbore;

a first counter, wherein, in response to firing the first addressable switch, the first counter is adapted to be incremented for the first addressable switch associated with the plug;

and a second counter, wherein, in response to firing the second addressable switch, the second counter is adapted to be incremented for the second addressable switch associated with the perforating gun.

2. The perforating gun string of claim 1, further comprising:

a counter system comprising the first and second counters;

wherein, after incrementing the first counter for the first addressable switch, the counter system is adapted to communicate a run tally for the first counter via a display; and wherein, after incrementing the second counter for the second addressable switch, the counter system is adapted to communicate a run tally for the second counter via the display.

3. The perforating gun string of claim 1, further comprising:

an igniter operably coupled to the first addressable switch, wherein firing the first addressable switch initiates the igniter to set the plug downhole in the wellbore.

4. The perforating gun string of claim 1, further comprising:

a detonator operably coupled to the second addressable switch, wherein firing the second addressable switch initiates the detonator to detonate the perforating gun downhole in the wellbore.

5. The perforating gun string of claim 1, further comprising:

a release tool;

wherein the plurality of addressable switches further comprises:

a third addressable switch associated with the release tool and fireable to release the perforating gun and the plug into the wellbore from the release tool.

6. The perforating gun string of claim 5, further comprising:

a third counter;

wherein, further in response to firing the first addressable switch associated with the plug, the third counter is adapted to be incremented for the third addressable switch associated with the release tool;

and a counter system comprising the first, second, and third counters;

wherein, after incrementing the first counter for the first addressable switch, the counter system is adapted to communicate a run tally for the first counter via a display; and wherein, after incrementing the second counter for the second addressable switch, the counter system is adapted to communicate a run tally for the second counter via the display; and wherein, after incrementing the third counter for the third addressable switch, the counter system is adapted to communicate a run tally for the third counter via the display.

7. The perforating gun string of claim 5, further comprising:

a detonator operably coupled to the third addressable switch, wherein firing the third addressable switch initiates the detonator to release the perforating gun and the plug in to the wellbore from the release tool.

8. The perforating gun string of claim 1, wherein each of the first and second counters is built into one or any combination of the plurality of addressable switches.

9. A method of tracking usage of one or more addressable switches in a perforating gun string, the method comprising:

firing a first addressable switch associated with a plug of the perforating gun string to set the plug downhole in a wellbore;

in response to firing the first addressable switch, incrementing a first counter of the perforating gun string for the first addressable switch associated with the plug of the perforating gun string;

firing a second addressable switch associated with a perforating gun of the perforating gun string to detonate the perforating gun downhole in the wellbore; and in response to firing the second addressable switch, incrementing a second counter of the perforating gun string for the second addressable switch associated with the perforating gun of the perforating gun string.

10. The method of claim 9, further comprising:

after incrementing the first counter for the first addressable switch, communicating a run tally for the first counter via a display; and after incrementing the second counter for the second addressable switch, communicating a run tally for the second counter via the display.

11. The method of claim 9, wherein the first addressable switch is operably coupled to an igniter; and wherein firing the first addressable switch initiates the igniter to set the plug downhole in the wellbore.

12. The method of claim 9, wherein the second addressable switch is associated with a detonator; and wherein firing the second addressable switch initiates the detonator to detonate the perforating gun downhole in the wellbore.

13. The method of claim 9, further comprising:

further in response to firing the first addressable switch associated with the plug, incrementing a third counter of the perforating gun string for a third addressable switch associated with a release tool of the perforating gun string, wherein the third addressable switch is fireable to release the perforating gun and the plug downhole into the wellbore from the release tool.

14. The method of claim 13, wherein the third addressable switch is operably coupled to a detonator; and wherein the third addressable switch is fireable to initiate the detonator to release the perforating gun and the plug downhole into the wellbore from the release tool.

15. The method of claim 13, further comprising:

after incrementing the third counter for the third addressable switch, communicating a run tally for the third counter via the display.

16. An apparatus adapted to track usage of one or more addressable switches in a perforating gun string, the apparatus comprising:

a non-transitory computer readable medium; and a plurality of instructions stored on the non-transitory computer readable medium and executable by one or more processors to implement the following steps:

firing a first addressable switch associated with a plug of the perforating gun string to set the plug downhole in a wellbore;

in response to firing the first addressable switch, incrementing a first counter of the perforating gun string for the first addressable switch associated with the plug of the perforating gun string;

firing a second addressable switch associated with a perforating gun of the perforating gun string to detonate the perforating gun downhole in the wellbore; and in response to firing the second addressable switch, incrementing a second counter of the perforating gun string for the second addressable switch associated with the perforating gun of the perforating gun string.

17. The apparatus of claim 16, wherein the plurality of instructions stored on the non-transitory computer readable medium are executable by the one or more processors to implement the following additional steps:

after incrementing the first counter for the first addressable switch, communicating a run tally for the first counter via a display; and after incrementing the second counter for the second addressable switch, communicating a run tally for the second counter via the display.

18. The apparatus of claim 16, wherein the first addressable switch is operably coupled to an igniter; and wherein firing the first addressable switch initiates the igniter to set the plug downhole in the wellbore.

19. The apparatus of claim 16, wherein the second addressable switch is associated with a detonator; and wherein firing the second addressable switch initiates the detonator to detonate the perforating gun downhole in the wellbore.

20. The apparatus of claim 16, wherein the plurality of instructions stored on the non-transitory computer readable medium are executable by the one or more processors to implement the following additional steps:

further in response to firing the first addressable switch associated with the plug, incrementing a third counter of the perforating gun string for a third addressable switch associated with a release tool of the perforating gun string, wherein the third addressable switch is fireable to release the perforating gun and the plug downhole into the wellbore from the release tool.

21. The apparatus of claim 20, wherein the third addressable switch is operably coupled to a detonator; and wherein the third addressable switch is fireable to initiate the detonator to release the perforating gun and the plug downhole into the wellbore from the release tool.

22. The apparatus of claim 20, wherein the plurality of instructions stored on the non-transitory computer readable medium are executable by the one or more processors to implement the following additional step:

after incrementing the third counter for the third addressable switch, communicating a run tally for the third counter via the display.

23. A counter system adapted to track usage of a plurality of addressable switches in a perforating gun string, the perforating gun string comprising:

a perforating gun;

a plug; and the plurality of addressable switches, comprising:

a first addressable switch associated with the plug and fireable to set the plug downhole in a wellbore; and a second addressable switch associated with the perforating gun and fireable to detonate the perforating gun downhole in the wellbore;

the counter system comprising first and second counters;

wherein, in response to firing the first addressable switch, the first counter is adapted to be incremented for the first addressable switch associated with the plug; and wherein, in response to firing the second addressable switch, the second counter is adapted to be incremented for the second addressable switch associated with the perforating gun.

24. The counter system of claim 23, wherein, after incrementing the first counter for the first addressable switch, the counter system is adapted to communicate a run tally for the first counter via a display; and wherein, after incrementing the second counter for the second addressable switch, the counter system is adapted to communicate a run tally for the second counter via a display.

25. The counter system of claim 23, wherein the perforating gun string further comprises:

an igniter operably coupled to the first addressable switch, wherein firing the first addressable switch initiates the igniter to set the plug downhole in the wellbore.

26. The counter system of claim 23, wherein the perforating gun string further comprises:

a detonator operably coupled to the second addressable switch, wherein firing the second addressable switch initiates the detonator to detonate the perforating gun downhole in the wellbore.

27. The counter system of claim 23, wherein the perforating gun string further comprises:

a release tool;

wherein the plurality of addressable switches further comprises:

a third addressable switch associated with the release tool and fireable to release the perforating gun and the plug into the wellbore from the release tool.

28. The counter system of claim 27, further comprising:

a third counter;

wherein, further in response to firing the first addressable switch associated with the plug, the third counter is adapted to be incremented for the third addressable switch associated with the release tool; and wherein, after incrementing the first counter for the first addressable switch, the counter system is adapted to communicate a run tally for the first counter via a display;

wherein, after incrementing the second counter for the second addressable switch, the counter system is adapted to communicate a run tally for the second counter via a display; and wherein, after incrementing the third counter for the third addressable switch, the counter system is adapted to communicate a run tally for the third counter via the display.

29. The counter system of claim 27, wherein the perforating gun string further comprises:

a detonator operably coupled to the third addressable switch, wherein firing the third addressable switch initiates the detonator to release the perforating gun and the plug in to the wellbore from the release tool.

30. The counter system of claim 23, wherein each of the first, second, and third counters is built into one or any combination of the plurality of addressable switches.

* * * * *